US008348118B2

(12) United States Patent
Segura

(10) Patent No.: US 8,348,118 B2
(45) Date of Patent: Jan. 8, 2013

(54) FASTENER-DRIVING TOOL HAVING TRIGGER CONTROL MECHANISM FOR ALTERNATIVELY PERMITTING BUMP FIRING AND SEQUENTIAL FIRING MODES OF OPERATION

(75) Inventor: Ricardo Segura, Lake in the Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 660 days.

(21) Appl. No.: 12/226,483

(22) PCT Filed: Mar. 15, 2007

(86) PCT No.: PCT/US2007/006476

§ 371 (c)(1),
(2), (4) Date: Jan. 26, 2009

(87) PCT Pub. No.: WO2007/133329

PCT Pub. Date: Nov. 22, 2007

(65) Prior Publication Data

US 2009/0314818 A1 Dec. 24, 2009

(51) Int. Cl.
*B25C 1/006* (2006.01)

(52) U.S. Cl. ..... 227/130; 227/8; 227/142; 227/156

(58) Field of Classification Search ..... 227/8, 130, 227/142, 156
See application file for complete search history.

(56) References Cited

U.S. PATENT DOCUMENTS

| | | | | |
|---|---|---|---|---|
| 5,593,079 | A | 1/1997 | Mukoyama et al. | |
| 6,116,488 | A * | 9/2000 | Lee | 227/8 |
| 6,860,416 | B1 | 3/2005 | Chen | |
| 6,953,137 | B2 | 10/2005 | Nakano et al. | |
| 7,152,773 | B2 * | 12/2006 | Ke | 227/8 |
| 2002/0056739 | A1 * | 5/2002 | Liu | 227/8 |

* cited by examiner

*Primary Examiner* — M. Alexandra Elve
*Assistant Examiner* — Nathaniel Chukwurah
(74) *Attorney, Agent, or Firm* — Law Offices of Steven W. Weinrieb

(57) ABSTRACT

A new and improved trigger control assembly (110) for switching the mode operation of the fastener-driving tool (112) between a sequential mode of operation and a bump firing mode operation. The trigger member (134) is provided with a pair of throughbores (140, 142) for alternating accommodating a pivot pin (144) by which the trigger member (134) may be pivotally mounted upon the fastener-driving tool housing (114) at two different positions whereby the workpiece contacting element (116) of the fastener driving tool (112) will engage the actuation lever (160) of the trigger member (134) at different positions so as to achieve the sequential and bump-firing modes of operation.

12 Claims, 11 Drawing Sheets

FASTENER-DRIVING TOOL HAVING TRIGGER CONTROL MECHANISM FOR ALTERNATIVELY PERMITTING BUMP FIRING AND SEQUENTIAL FIRING MODES OF OPERATION

FIELD OF THE INVENTION

The present invention relates generally to powered, fastener-driving tools, wherein the tools may be electrically powered, pneumatically powered, combustion powered, or powder activated, and more particularly to a new and improved fastener-driving tool having a trigger control mechanism that is capable of being mounted upon the powered, fastener-driving tool at either one of two different, substantially laterally or transversely spaced positions such that when the trigger control mechanism is disposed at a first one of the two different, substantially laterally or transversely spaced positions, the trip lever member of the trigger control mechanism will be positioned so as to enable the tool to be operated only in accordance with a sequential firing mode of operation, whereas when the trigger control mechanism is disposed at a second one of the two different, substantially laterally or transversely spaced positions, the trip lever member of the trigger control mechanism will be positioned so as to enable the tool to be operated in accordance with a bump firing mode of operation.

BACKGROUND OF THE INVENTION

Powered, fastener-driving tools, of the type used to drive various fasteners, such as, for example, staples, nails, and the like, typically comprise a housing, a power source, a supply of fasteners, a trigger mechanism for initiating the firing of the tool, and a workpiece-contacting element. The workpiece-contacting element is adapted to engage or contact a workpiece, and is operatively connected to the trigger mechanism, such that when the workpiece-contacting element is in fact disposed in contact with the workpiece, and depressed or moved inwardly a predetermined amount with respect to the tool, as a result of the tool being pressed against or moved toward the workpiece a predetermined amount, the trigger mechanism will in fact be enabled so as to initiate firing of the fastener-driving tool. As is well-known in the art, powered, fastener-driving tools normally have two kinds or types of operational modes, and the tool is accordingly provided with some mechanism, such as, for example, a lever, a latch, a switch, or the like, for enabling the operator to optionally select the one of the two types or kinds of operational modes that the operator desires to use in accordance with a particularly apt mode of installing the fasteners. More particularly, in accordance with a first one of the two types or kinds of modes of operating the powered, fastener-driving tool, known in the industry and art as the sequential or single-shot mode of operation, the depression or actuation of the trigger mechanism will not in fact initiate the firing of the tool and the driving of a fastener into the workpiece unless the workpiece-contacting element is initially depressed against the workpiece. Considered from a different point of view or perspective, in order to operate the powered, fastener-driving tool in accordance with the sequential or single-shot mode of operation, the workpiece contacting element must first be depressed against the workpiece followed by the depression or actuation of the trigger mechanism. Still further, once the particular fastener has in fact been driven into the workpiece, further or repeated depression or actuation of the trigger mechanism will not result in the subsequent driving of additional fasteners into the workpiece unless, and until, the workpiece contacting element is permitted to effectively be reset to its original position and once again disposed in contact with, and pressed against, the workpiece prior to the depression or actuation of the trigger mechanism each time the tool is to be fired so as to drive a fastener into the workpiece. Alternatively, in accordance with a second one of the two types or kinds of modes of operating the powered, fastener-driving tool, known in the industry and art as the bump-firing mode of operation, the operator can in fact maintain the trigger mechanism at its depressed position, and subsequently, each time the workpiece contacting element is disposed in contact with, and pressed against, the workpiece, the tool will fire, thereby driving a fastener into the workpiece.

Continuing further, trigger assemblies are known wherein mechanisms are provided upon, or incorporated within, the trigger assemblies of the fastener-driving tools for permitting the operator to optionally select the particular one of the two types or kinds of modes of operating the powered, fastener-driving tool that the operator desires to implement in order to drive fasteners into the workpiece in a predetermined manner so as to achieve predetermined fastening procedures. One such trigger assembly is disclosed, for example, within U.S. Pat. No. 6,543,664 which issued to Wolfberg on Apr. 8, 2003. In accordance with the disclosed control system of Wolfberg, and with reference being made to FIG. 1, which substantially corresponds to FIG. 3 of the noted patent to Wolfberg, the trigger assembly is disclosed at 16 and is seen to comprise a trigger 18 which includes a pair of spaced apart side walls 20 between which there is interposed a finger contact portion 22. The side walls 20 and the finger contact portion 22 effectively define an inner cavity 30 that is open at the upper end portion 32 thereof, and an actuation lever 34 is disposed within the inner cavity 30. The actuation lever 34 is pivotally mounted within the inner cavity 30 by means of an end portion 38 thereof, which comprises an eyelet or throughbore 40 within which there is disposed a pivot pin 42, and the actuation lever 34 also comprises a free distal end portion 36. An upper corner portion of each one of the side walls 20 is provided with an eyelet or throughbore 26 within which a pivot pin 28 is disposed, and in this manner, the entire trigger assembly 16 is pivotally mounted upon the tool housing 12.

It is further seen that the pair of side walls 20 are provided with a pair of notches 46,48 within which the pivotal end portion 38 of the actuation lever 34 can be selectively disposed such that the operator can operationally choose which mode of operation the fastener-driving tool will perform, that is, either the sequential firing mode of operation or the bump firing mode of operation, and it is seen still further that the fastener-driving tool also comprises a workpiece contacting element 44. As a result of the pivotal end portion 38 of the actuation lever 34 being disposed within either one of the two positions determined by means of the pair of notches 46, 48, the free distal end portion 36 of the actuation lever 34 may be disposed relatively closer to, or farther from, a trigger end portion 60 of the workpiece contacting element 44. More particularly, when the actuation lever 34 is disposed relatively further away from the trigger end portion 60 of the workpiece contacting element 44, the fastener-driving tool will be disposed in its sequential firing mode of operation, whereas when the actuation lever 34 is disposed relatively closer to the trigger end portion 60 of the workpiece contacting element 44, the fastener-driving tool will be disposed in its bump-firing mode of operation. It is seen still further that the fastener-driving tool further comprises a control valve 52 which initiates firing of the fastener-driving tool, whereby a fastener is driven outwardly from the fastener-driving tool and into the workpiece, and that a coiled spring 54 circumscribes the control valve 52 so as to be interposed between the tool housing 12 and an upper surface portion 56 of the actuation lever 34. In this manner, the actuation lever 34 is effectively biased toward the finger contact portion 22 of the trigger 18 such that the pivot pin 42 of the pivotal end portion 38 of the actuation lever 34 is assuredly seated within one of the notches 46,48. It is further appreciated that the workpiece contacting element 44 comprises a plurality of linkage members 62 which effectively integrally interconnect the actual workpiece contacting member 64 with the trigger end portion 60 thereof.

In order to appreciate the achievement, for example, of the sequential firing of the fastener-driving tool, reference is made to FIGS. 1 and 2 of the drawings, which substantially correspond to FIGS. 3 and 4 of the aforenoted Wolfberg patent. More particularly, it is to be noted that in order to fire the fastener-driving tool, and thereby drive a fastener out from the fastener-driving tool and into a workpiece, the free distal end portion 36 of the actuation lever 34 must be disposed within the vicinity of the trigger end portion 60 of the workpiece contacting element 44 such that the actuation lever 34 can in fact be moved upwardly toward the control valve 52, by means of the trigger end portion 60 of the workpiece contacting element 44, when the workpiece contacting element 44 is depressed into contact with the workpiece, so as to be ready to be subsequently moved upwardly into contact with the control valve 52 by means of the finger contact portion 22 of the trigger 18 when the finger contact portion 22 of the trigger 18 is in fact depressed or moved upwardly. Accordingly, when in fact a sequential firing mode of operation of the fastener-driving tool is to be performed, the operator will dispose the workpiece contacting member 64 of the workpiece contacting element 44 into contact with the workpiece, and subsequently, the operator will effectively move the fastener-driving tool downwardly, or toward the workpiece, causing the workpiece contacting element 44 to effectively move upwardly relative to the tool housing 12.

As a result of such relative upward movement of the workpiece contacting element 44, the trigger end portion 60 of the workpiece contacting element 44 will engage the free distal end portion 36 of the actuation lever 34 so as to move the actuation lever 34 upwardly toward the control valve 52. Subsequently, when the finger contact portion 22 of the trigger 18 is depressed or moved upwardly with respect to the tool housing 12, the entire trigger assembly 16 will be pivotally moved around the pivot pin 28 such that the actuation lever 34 can now in fact contact and actuate the control valve 52 whereby firing of the fastener-driving tool, as a result of which a fastener is discharged outwardly from the fastener-driving tool and into the workpiece, occurs. It is to be additionally noted, however, that as a result of the aforenoted pivotal movement of the entire trigger assembly 16 around the pivot pin 28 in accordance with the depression or upward movement of the finger contact portion 22 of the trigger 18 relative to the tool housing 12, the free distal end portion 36 of the actuation lever 34 will also move slightly toward the right, as viewed in FIGS. 1 and 2, relative to the vertically oriented linear path of movement of the trigger end portion 60 of the workpiece contacting element 44, as can be appreciated from a comparison of the relative disposition of the free distal end portion 36 of the actuation lever 34, during both the non-actuated or non-depressed, and the actuated or depressed, states of the finger contact portion 22 of the trigger 18 as respectively illustrated within FIGS. 1 and 2.

Accordingly, if the operator maintains the finger contact portion 22 of the trigger 18 at its depressed or upwardly moved, pivotal position relative to the tool housing 12, then when the operator removes the fastener-driving tool from its contact or depressed state with respect to the workpiece, in order to, for example, move the fastener-driving tool to a new or other location, relative to the workpiece, at which another fastener is to be driven into the workpiece, the workpiece contacting element 44 will be moved downwardly, under the biasing influence of its spring-biasing means, not illustrated, such that the trigger end portion 60 of the workpiece contacting element 44 will effectively be released or disengaged from the free distal end portion 36 of the actuation lever 34. Therefore, the actuation lever 34 will, in turn, move downwardly away from the control valve 52, under the biasing influence of the coil spring 54, so as to attain the position illustrated within FIG. 2 wherein it is noted that the free distal end portion 36 of the actuation lever 34 is in fact removed from the vertically oriented linear path of movement of the trigger end portion 60 of the workpiece contacting element 44. Accordingly, if the operator then depresses the workpiece contacting element 44 into contact with the workpiece at the new location at which the next fastener is to be driven into the workpiece, the relative upward movement of the workpiece contacting element 44 will not result in the trigger end portion 60 of the workpiece contacting element 44 engaging the free distal end portion 36 of the actuation lever 34, but to the contrary, will effectively bypass the same, whereby the actuation lever 34 will not be capable of actuating the control valve 52 so as to initiate a new firing cycle within the fastener-driving tool.

It is to be additionally appreciated that this mode of operation, or failure of operation, will also occur if, subsequent to the successful firing of the fastener-driving tool, the finger contact portion 22 of the trigger 18 is in fact released back to its non-depressed state or position as illustrated within FIG. 1, the workpiece contacting element 44 is released from its depressed state or position with respect to the workpiece whereby the workpiece contacting element 44 will effectively move vertically downwardly, and prior to the disposition of the workpiece contacting element 44 in a depressed engaged state with respect to a new site of the workpiece at which a new fastener is to be driven into the workpiece, the finger contact portion 22 of the trigger 18 is again depressed or moved upwardly with respect to the tool housing 12. In other words, in accordance with the sequential firing mode of operation, the workpiece contacting element 44 must always be moved into depressed contact engagement with a portion of the workpiece prior to the depression or upward movement of the finger contact portion 22 of the trigger 18 with respect to the tool housing 12.

Alternatively, as can best be appreciated from FIGS. 3 and 4, which substantially correspond to FIGS. 5 and 6 of the aforenoted Wolfberg patent, when the fastener-driving tool is desired to be operated in accordance with the bump-firing mode of operation, it is noted that the actuation lever 34 is initially moved toward the left, as viewed within FIGS. 3 and 4, such that the pivotal end portion 38 of the actuation lever 34 is now disposed within the notch 46 whereby the free distal end portion 36 of the actuation lever 34 is disposed closer to the trigger end portion 60 of the workpiece contacting element 44. This movement of the actuation lever 34 may be achieved by inserting a pointed object, such as, for example, a nail, or the like, into one end of the pivot pin 42 of the pivotal end portion 38 of the actuation lever 34, the pivot pin 42 comprising a hollow tubular structure or having recessed means formed within an end portion thereof for accommodating the nail or the like. As illustrated within FIG. 5, all components are disposed at their normal static positions, that is, the workpiece contacting element 44 has not yet been depressed against the workpiece so as not to as yet have been moved upwardly with respect to the tool housing 12, and the finger contact portion 22 of the trigger 18 has likewise not as yet been depressed or moved upwardly.

Accordingly, with the component parts disposed at their relative positions illustrated within FIG. 3, if the workpiece contacting element 44 is initially depressed into contact with a workpiece and is accordingly moved upwardly with respect to the tool housing 12, and if the finger contact portion 22 of the trigger 18 is subsequently depressed or moved upwardly with respect to the tool housing 12, then the firing mode of operation is substantially the same as that previously described in connection with the sequential firing mode of operation. However, it is to be noted that once a fastener-driving tool firing and fastener driving cycle has been completed, and another fastener-driving tool firing and fastener driving cycle is to be implemented so as to discharge another fastener out from the fastener-driving tool and drive the same into the workpiece, if the finger contact portion 22 of the trigger 18 is maintained at its depressed or upward position, as illustrated within FIG. 4, and if the workpiece contacting element 44 has been removed from its depressed contact engagement state with respect to the workpiece such that the workpiece contacting element 44 has been moved downwardly relative to the tool housing 12 under the influence of its spring biasing means, not shown, as is also illustrated within FIG. 4, the free distal end portion 36 of the actuation lever 34 will still remain disposed within the vertically oriented linear path of movement of the trigger end portion 60 of the workpiece contacting element 44 due to the previously noted relative leftward disposition of the actuation lever 34 as a result of the location of the pivotal end portion 38 of the actuation lever 34 within the notch 46. Accordingly, unlike the sequential firing mode of operation, when the workpiece contacting element 44 is again disposed in a depressed state against the workpiece, the trigger end portion 60 of the workpiece contacting element 44 can once again move the actuation lever 34 into engagement with the control valve 52 so as to in fact initiate a new firing mode or cycle within the fastener-driving tool. Therefore, relatively rapid firing of the fastener-driving tool in accordance with the bump-firing mode of operation can be achieved each time the workpiece contacting element is disposed in depressed contact against a workpiece.

While it can be appreciated that the aforenoted system of Wolfberg can successfully enable the fastener-driving tool to achieve both sequential and bump-firing modes of operation by altering the disposition of the actuation lever 34 with respect to the trigger end portion 60 of the workpiece contacting element 44, it has been noted that sometimes it is difficult to manually manipulate the pivot pin 42 so as to effectively move the pivotal end portion 38 of the actuation lever 34 from one of the notches 46,48 to the other one of the notches 46,48 in order to effectively change-over or alter the firing mode of operation of the fastener-driving tool. As has been noted, in order to achieve such an alteration in the firing mode of operation of the fastener-driving tool, a nail or similarly sharp-pointed object must be inserted into at least one of the hollow or recessed ends of the pivot pin 42, and in addition, the pivotal end portion 38 of the actuation lever 34 must be disengaged from one of the notches 46,48, against the biasing force of coiled spring 54, so as to permit the pivot pin 42 to then be inserted into the other one of the notches 46,48.

A need therefore exists in the art for a new and improved fastener-driving tool wherein the trigger control mechanism or assembly can be readily, quickly, and easily moved or manipulated to either one of two predetermined positions or states so as to permit the fastener-driving tool to be alternatively operated in accordance with either one of the bump firing or sequential firing modes of operation.

SUMMARY OF THE INVENTION

The foregoing and other objectives are achieved in accordance with the teachings and principles of the present invention through the provision of a new and improved fastener-driving tool which has a trigger control mechanism or assembly for alternatively permitting bump firing and sequential firing modes of operation, wherein the trigger control mechanism of assembly is provided with a pair of laterally or transversely spaced apertures or through-bores within which a pin is adapted to be selectively disposed so as to pivotally mount the trigger control mechanism or assembly upon the tool housing at either one of two laterally or transversely spaced positions. Accordingly, when, for example, the mounting pin is disposed within the first one of the two transversely or laterally spaced apertures or through-bores, the trigger control mechanism or assembly will be disposed at the first one of its two laterally or transversely spaced positions upon the fastener-driving tool such that the fastener-driving tool can be operated in its sequential firing mode of operation, whereas when the mounting pin is disposed within the second one of the two transversely or laterally spaced apertures or through-bores, the trigger control mechanism or assembly will be disposed at the second one of its two laterally or transversely spaced positions upon the fastener-driving tool such that the fastener-driving tool can be operated in its bump firing mode of operation.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
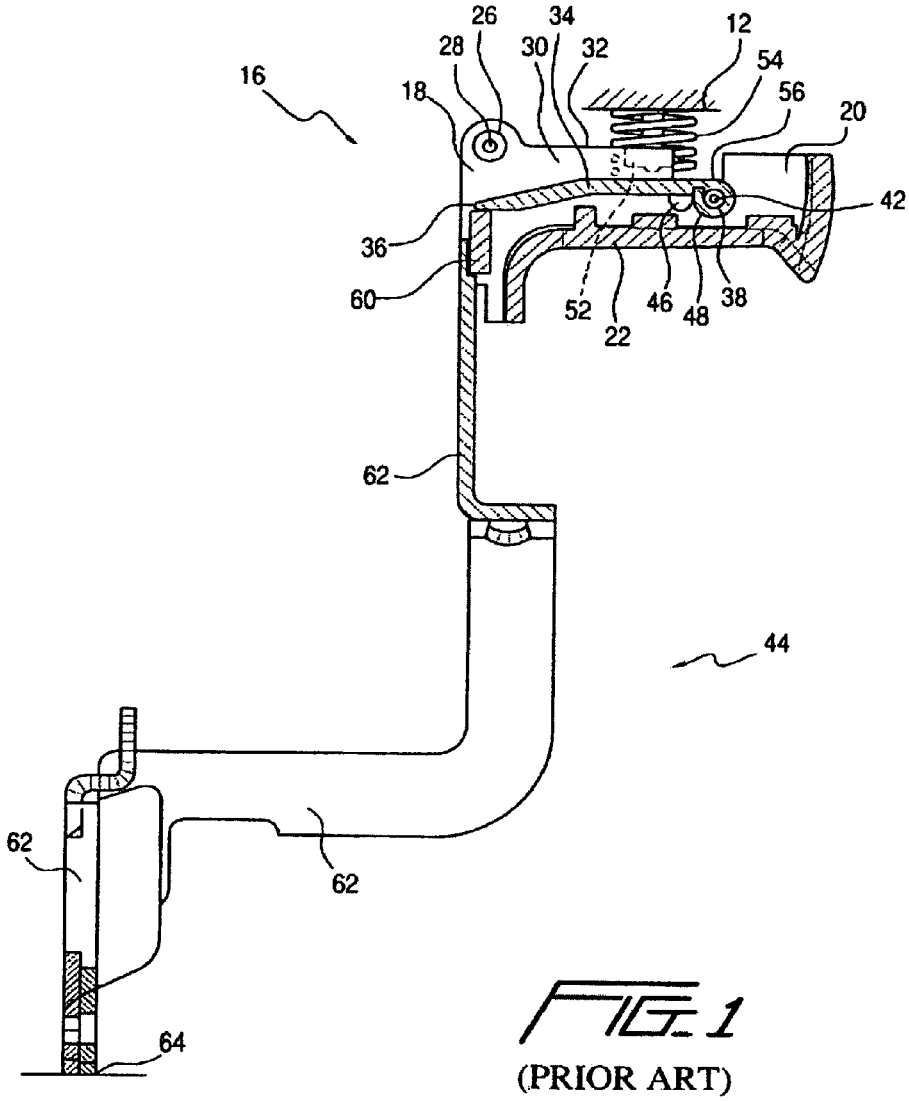
FIG. 1 (PRIOR ART)
FIG. 1 is a cross-sectional view of a conventional, PRIOR ART trigger control mechanism for a fastener-driving tool wherein the actuation lever is positioned upon the trigger assembly at its sequential firing mode position, the workpiece contacting element has been depressed against the workpiece, but the finger contact portion of the trigger has not yet been depressed or moved upwardly.
Figure 2:
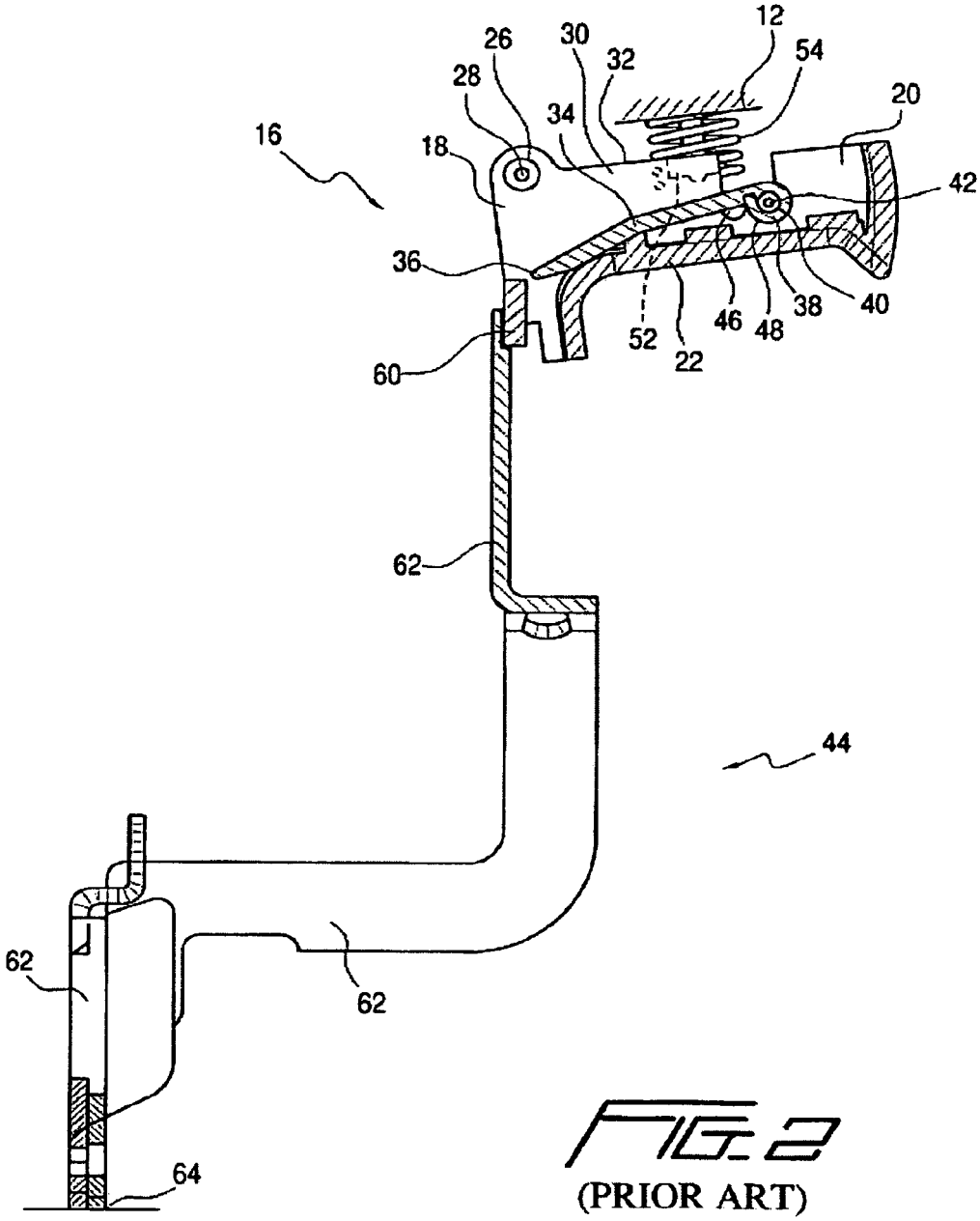
FIG. 2 (PRIOR ART)
FIG. 2 is a cross-sectional view of the conventional, PRIOR ART trigger control mechanism for the fastener-driving tool, as disclosed within FIG. 1, wherein the actuation lever is positioned upon the trigger assembly at its sequential firing mode position, the workpiece contacting element has been removed from its depressed state against the workpiece, and the finger contact portion of the trigger has been depressed or moved upwardly.
Figure 3:
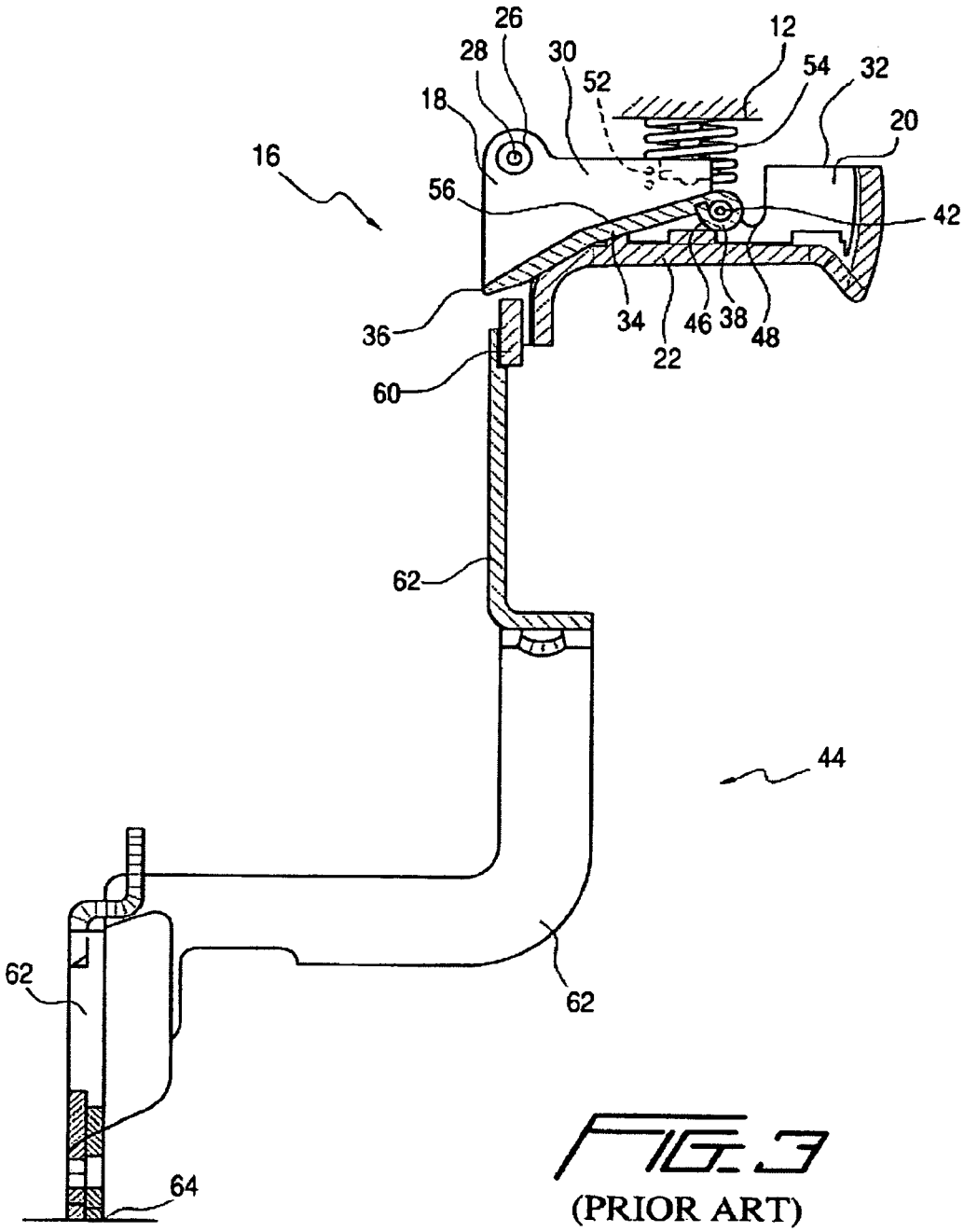
FIG. 3 (PRIOR ART)
FIG. 3 is a cross-sectional view of the conventional, PRIOR ART trigger control mechanism for the fastener-driving tool, as disclosed within FIGS. 1 and 2, wherein, however, the actuation lever is positioned upon the trigger assembly at its bump firing mode position, the workpiece contacting element has not as yet been depressed against the workpiece, and the finger contact portion of the trigger has not as yet been depressed or moved upwardly.
Figure 4:
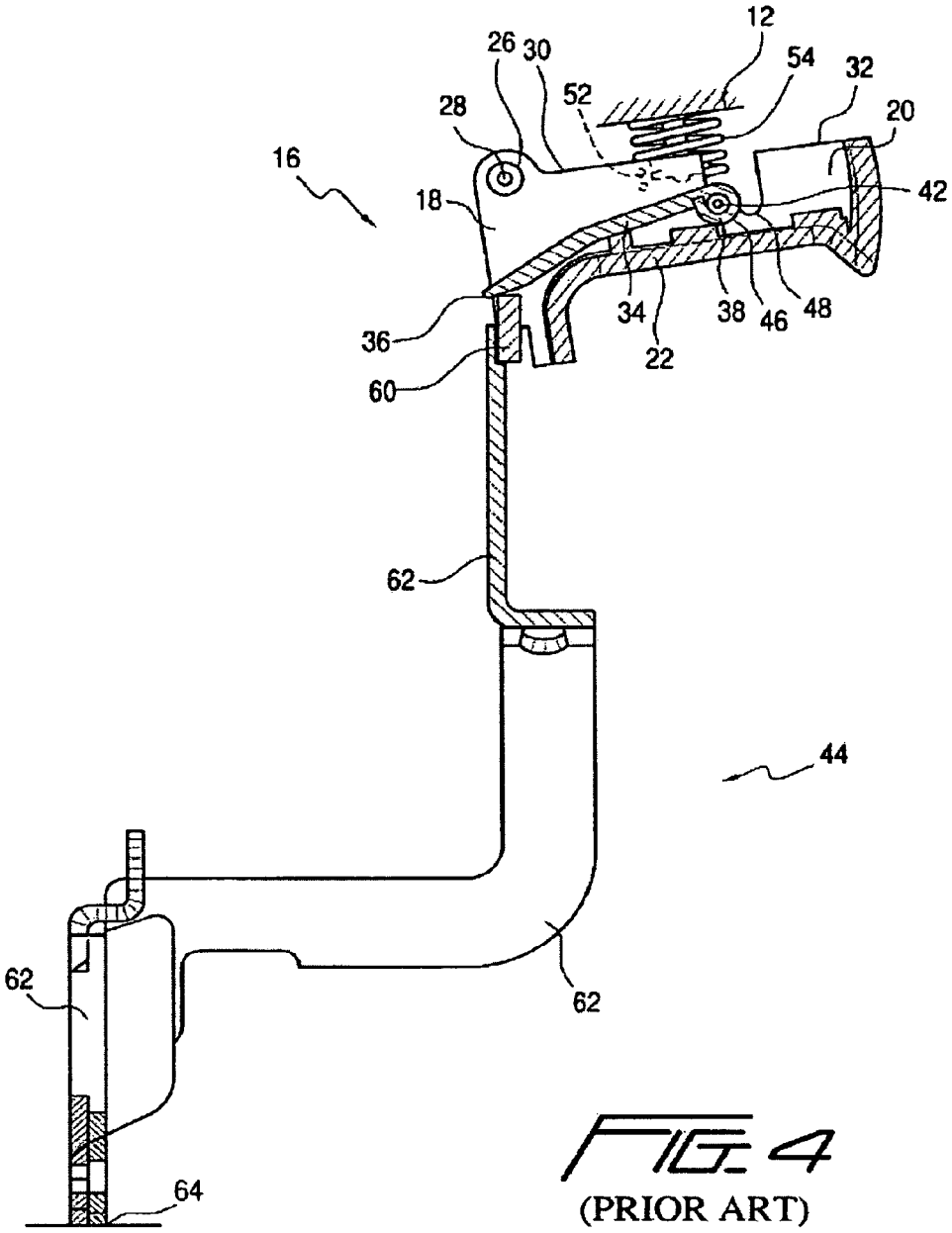
FIG. 4 (PRIOR ART)
FIG. 4 is a cross-sectional view of the conventional, PRIOR ART trigger control mechanism for the fastener-driving tool, as disclosed within FIG. 3, wherein the actuation lever is positioned upon the trigger assembly at its bump firing mode position, the workpiece contacting element has been depressed against the workpiece, and the finger contact portion of the trigger has been depressed or moved upwardly.
Figure 5:
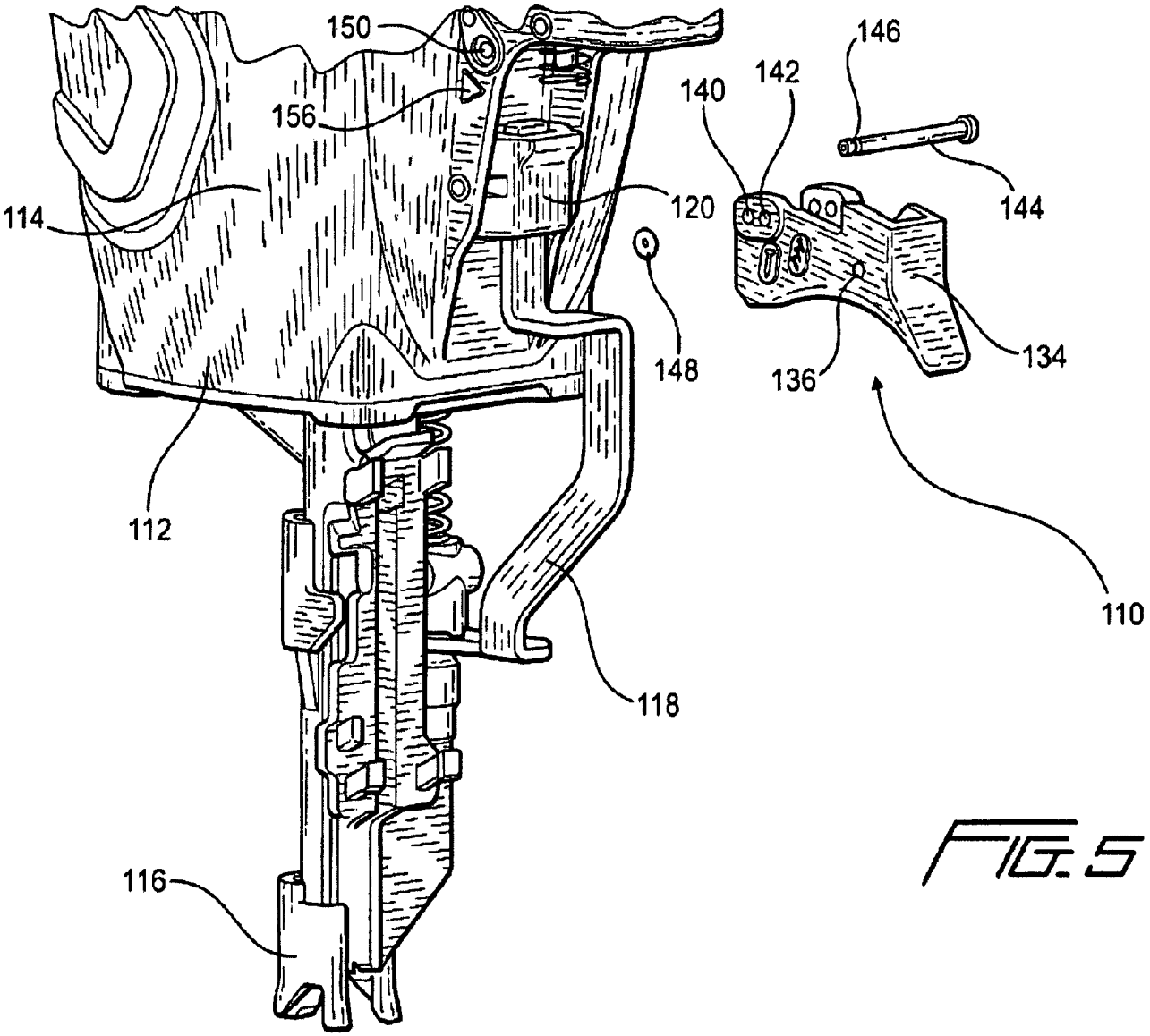
FIG. 5 is a perspective, partially exploded view of a fastener-driving tool having the new and improved trigger control mechanism or assembly, as constructed in accordance with the principles and teachings of the present invention, incorporated therein.
Figure 6:
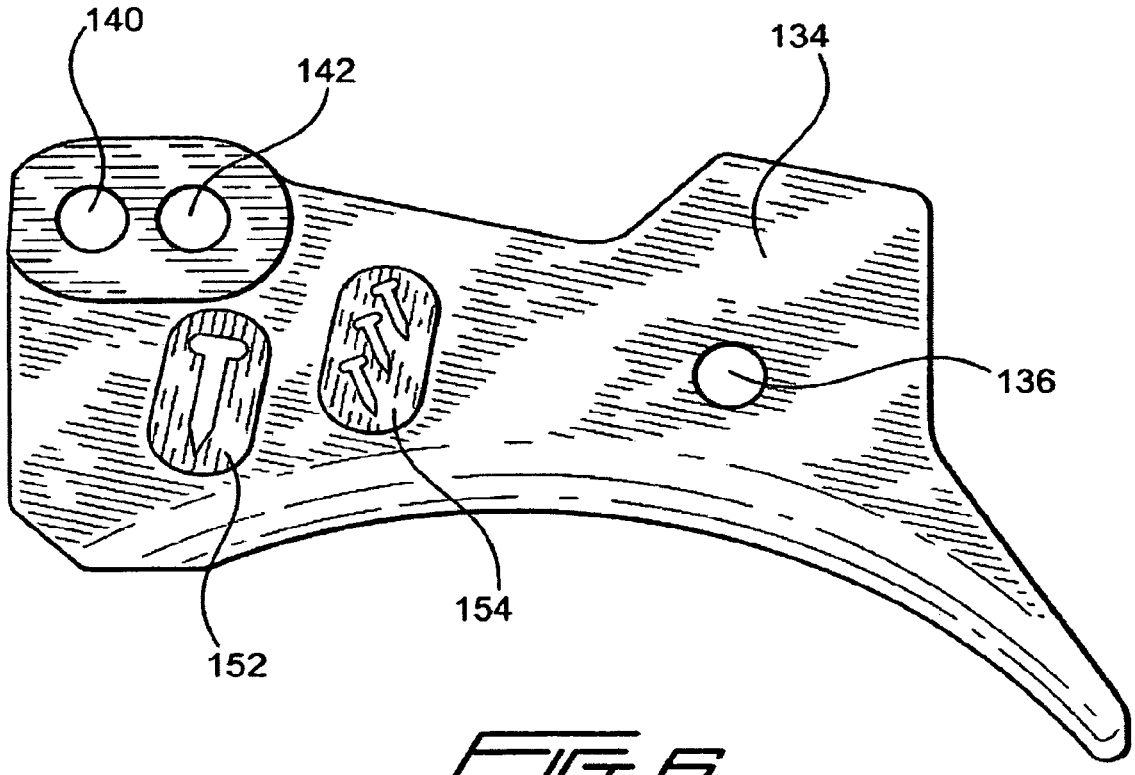
FIG. 6 is a side elevational view of the new and improved trigger control mechanism or assembly of the present invention.

Referring now to the drawings, and more particularly to FIGS. 5-8 thereof, the new and improved trigger control mechanism or assembly, as constructed in accordance with the principles and teachings of the present invention, is disclosed and is generally indicated by the reference character 110. More particularly, it is seen that the new and improved trigger control mechanism or assembly 110 is adapted to be mounted upon a fastener-driving tool 112 which comprises a fastener-driving tool housing 114. A workpiece contact element assembly, which actually comprises a lower workpiece contact element 116 which is adapted to be disposed on contact with a workpiece, and an upper workpiece contact element linkage member 118, is slidably mounted in a reciprocal manner upon the fastener-driving tool housing 114, and a guide member 120 is fixedly mounted upon the fastener-driving tool housing 114 so as to guide the upper free end distal portion of the upper workpiece contact element linkage member 118 during its movement with respect to the trigger control mechanism or assembly 110 as can best be appreciated, for example, from FIG. 9. Still further, a control valve mechanism or assembly 122 is mounted upon the fastener-driving tool housing 114 so as to initiate either a sequential or bump firing mode of operation of the fastener-driving tool 112 when the control valve mechanism or assembly 122 is actuated by means of the trigger control mechanism or assembly 110 of the present invention as will be described more fully hereinafter. More particularly, the control valve mechanism or assembly 122 is seen to comprise a valve member 124 which is adapted to be seated upon a valve seat 126, and a valve stem 128 which is adapted to be engaged by means of an actuation lever 130 of the trigger control mechanism or assembly 110. A coil spring 132 is disposed around the valve stem 128 and has its opposite ends engaged with the valve seat 126 and the actuation lever 130 so as to normally bias the actuation lever 130 away from the valve stem 128.

With continued reference being made to FIGS. 5-9, it is seen that the trigger control mechanism or assembly 110 comprises a trigger member 134 which essentially comprises a hollow housing structure having a pair of oppositely disposed side walls in order to accommodate the actuation lever 130 and the coil spring 132 components therebetween. More specifically, the trigger member 134 has a first through-bore 136 extending through the pair of oppositely disposed side walls for accommodating a first pivot pin 138 for pivotally mounting the actuation lever 130 within the trigger member 134, and second and third transversely spaced through-bores 140, 142, which also extend through the pair of oppositely disposed side walls, for alternatively accommodating a second pivot pin 144 for pivotally mounting the trigger member 134 upon the fastener-driving tool housing 114 at either one of two different positions. The non-headed end portion of the second pivot pin 144 is provided with an annular recess 146 within which an O-ring fastener 148 can be accommodated, and accordingly, when the second pivot pin 144 is inserted within either one of the second or third through-bores 140, 142, the second pivot pin 144 can be retained within the particular one of the second and third through-bores 140,142 by effectively snap-fitting the O-ring fastener 148 within the annularly recessed portion 146 of the second pivot pin 144.

The second pivot pin 144 is also adapted to be inserted through a through-bore 150 defined within the fastener-driving tool housing 114, and accordingly, it can be appreciated that by inserting the second pivot pin 144 through a particular one of the second or third through-bores 140,142 defined within the trigger member 134, the disposition of the trigger member 134, with respect to the fastener-driving tool housing 114, can be altered, as will be described more fully hereinafter, in order to selectively achieve the sequential and bump firing modes of operation of the fastener-driving tool 112. Alternatively, in lieu of providing the trigger member 134 with the pair of through-bores 140,142 and the fastener-driving tool housing 114 with the single through-bore 150, the trigger member 134 may be provided with a single through-bore while the fastener-driving tool housing 114 is provided with a pair of through-bores within which, for example, the second pivot pin 144 may be selectively disposed. As can best be seen from FIG. 6, the trigger member 134 is provided with first and second graphic indicia 152,154 which respectively illustrate a single nail-type fastener and a plurality of, or multiple, nail-type fasteners.

Figure 7:
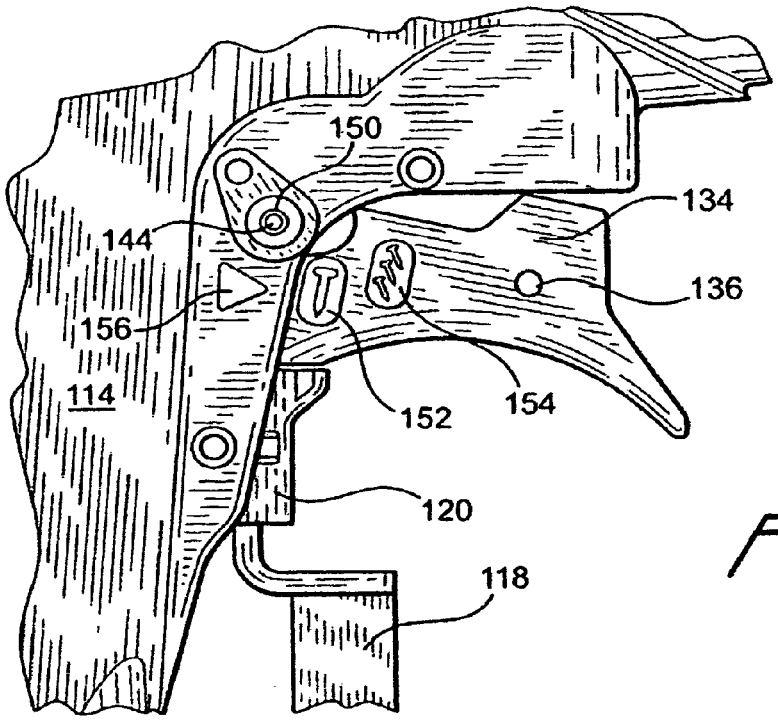
FIG. 7 is a side elevational view of the fastener-driving tool having the new and improved trigger control mechanism or assembly of the present invention as mounted upon the tool at its first position so as to enable the fastener-driving tool to be operated in accordance with its sequential firing mode of operation.
Figure 8:
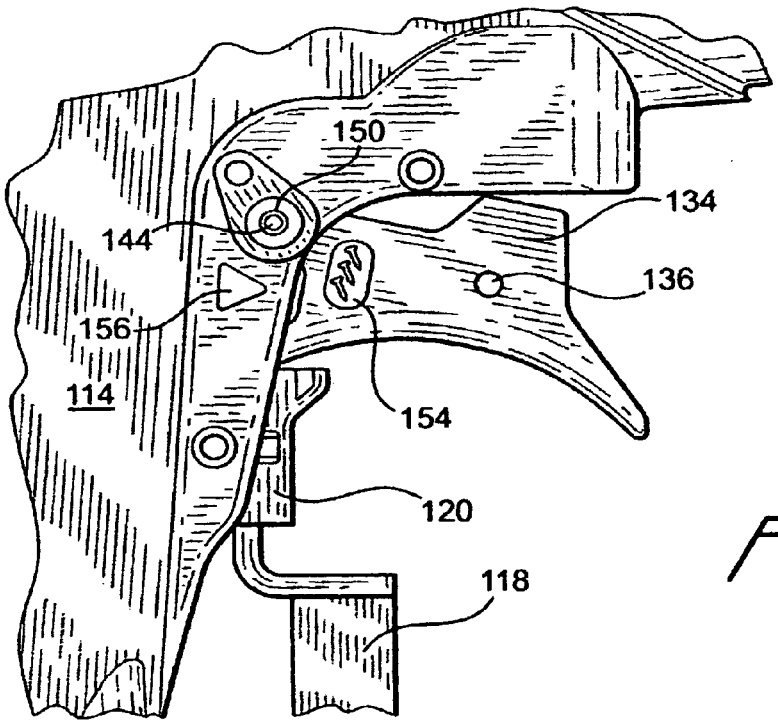
FIG. 8 is a side elevational view of the fastener-driving tool having the new and improved trigger control mechanism or assembly of the present invention as mounted upon the tool at its second position so as to enable the fastener-driving tool to be operated in accordance with its bump firing mode of operation.
Figure 9:
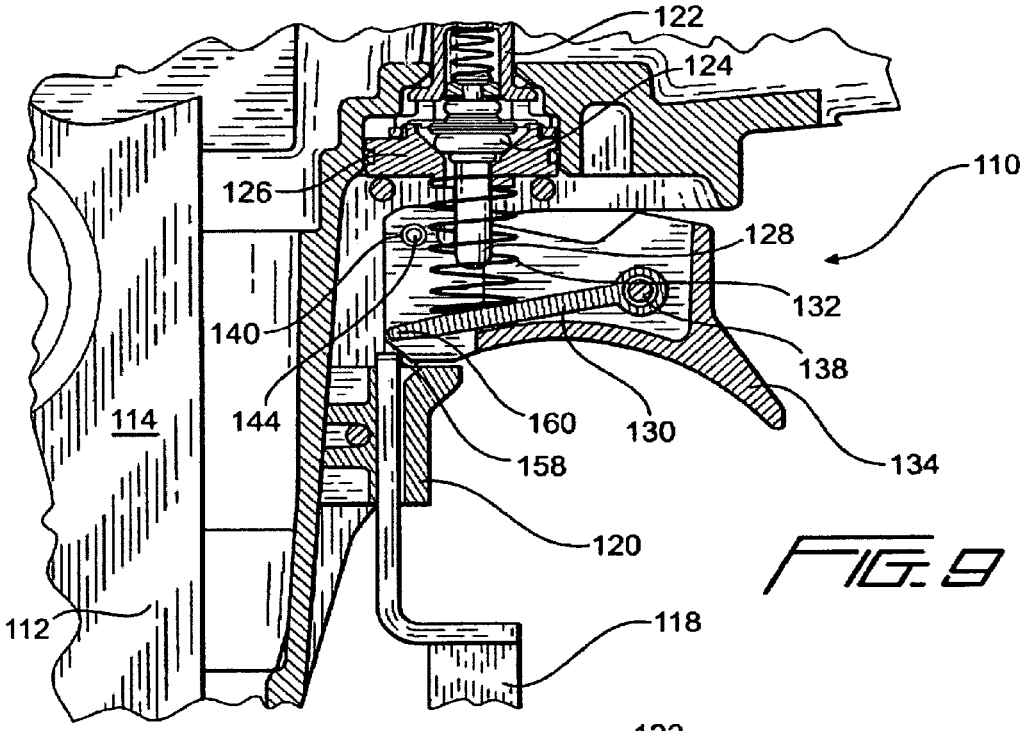
FIG. 9 is a cross-sectional view of the new and improved trigger control mechanism or assembly as pivotally mounted upon the fastener-driving tool housing wherein the workpiece contact element assembly, the actuation lever of the trigger control mechanism or assembly, and the trigger member of the trigger control mechanism or assembly are all disposed at their initial, lowered, START positions prior to the initiation or actuation of the fastener-driving tool in its sequential firing mode of operation wherein it is further noted, in particular, that the actuation lever of the trigger control mechanism or assembly is disengaged from the valve stem of the control valve mechanism or assembly of the fastener-driving tool.

In addition, the fastener-driving tool housing 114 is provided with an arrow 156, as can best be seen in FIGS. 7 and 8, which is adapted to point to such graphic indicia 152,154 so as to aid an operator in appreciating which mode of operation has effectively been pre-arranged or established within the fastener-driving tool 112. More particularly, when, for example, the trigger member 134 has been pivotally mounted upon the fastener-driving tool housing 114 as a result of the second pivot pin 144 having been inserted through the second through-bore 140, as disclosed within FIG. 7, whereby the fastener-driving tool 112 is set or arranged for a sequential firing mode of operation, the arrow 156 is seen to point to the graphic indicia 152 which illustrates the single nail-type fastener for indicating individual or sequential tool firing cycles. Alternatively, when, for example, the trigger member 134 has been pivotally mounted upon the fastener-driving tool housing 114 as a result of the second pivot pin 144 having been inserted through the third through-bore 142, as disclosed within FIG. 8, whereby the fastener-driving tool 112 is set or arranged for a bump firing mode of operation, the arrow 156 is seen to point to the graphic indicia 154 which illustrates the plurality or multiple nail-type fasteners for indicating multiple tool firing cycles characteristic of a bump firing mode of operation.

Having described the various structural components comprising the new and improved trigger control mechanism or assembly 110 of the present invention, a brief description of the operation of the same within both of the sequential firing and bump-firing modes of operation will now be described. With reference initially being made to FIGS. 9-13, the sequential firing mode of operation will firstly be described. As disclosed within FIG. 9, the trigger member 134 is pivotally mounted upon the fastener-driving tool housing 114 as a result of the second pivot pin 144 being disposed within the second through-bore 140 of the trigger member 134, whereby the various components of the new and improved trigger control mechanism or assembly 110 are disposed at their initial or START positions as illustrated FIG. 9. More particularly, for example, it is seen that the upper workpiece contact element 118 is disposed at its lowermost position as a result of the workpiece contact assembly not being engaged as yet with a workpiece, the actuation lever 130 of the trigger control mechanism or assembly 110 is disposed at its lowermost position so as to be disengaged from the lower end portion of the valve stem 128 of the control valve mechanism or assembly 122 whereby the valve member 124 of the control valve mechanism or assembly 122 is seated upon its valve seat 126, and the trigger member 134 of the trigger control mechanism or assembly 110 is also disposed at its lowermost non-depressed position. It is also noted that the upper end portion 158 of the upper workpiece contact element 118 is not engaged with, and is spaced beneath, the free distal end portion 160 of the actuation lever 130 as a result of the upper workpiece contact element 118 being disposed at its lowermost position in view of the fact that the workpiece contact assembly has not yet been engaged with the workpiece, however, it is also noted that the free distal end portion 160 of the actuation lever 130 is effectively disposed within the vertically oriented plane, within which the upper workpiece contact element 118 will be movably disposed once the workpiece contact assembly is engaged with the workpiece, such that the free distal end portion 160 of the actuation lever 130 will in fact be engaged by the upper end portion 158 of the upper workpiece contact element 118.

Figure 10:
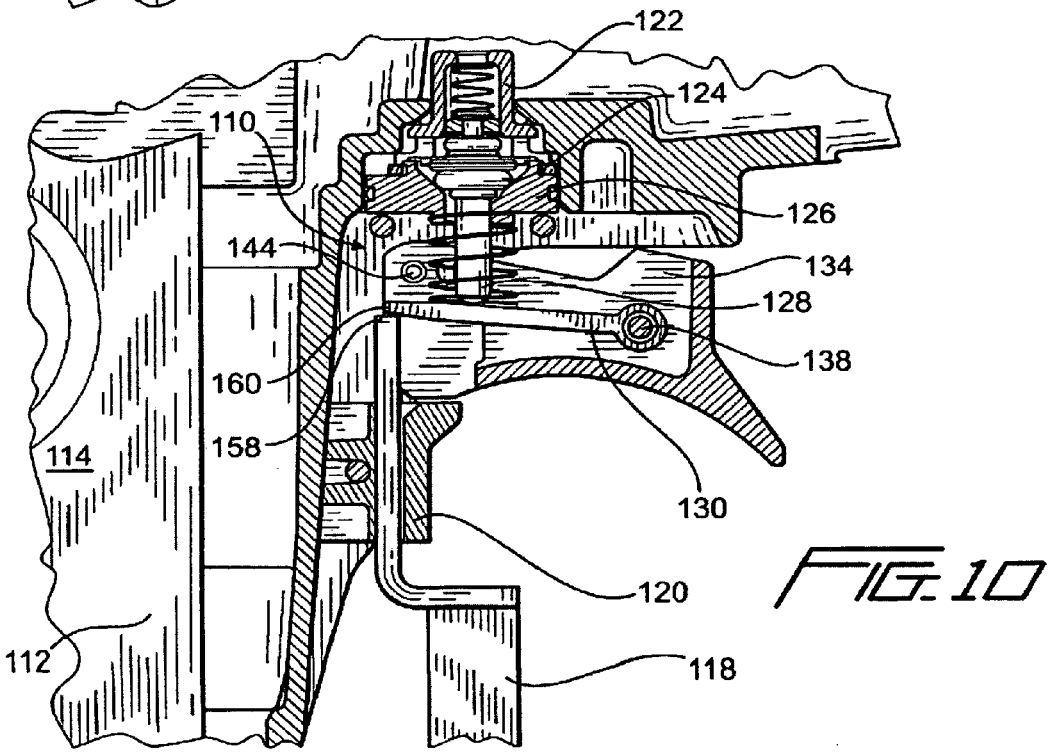
FIG. 10 is a cross-sectional view of the new and improved trigger control mechanism or assembly, similar to that disclosed within FIG. 9, wherein, however, the workpiece contact element assembly has been moved upwardly into engagement with the actuation lever of the trigger control mechanism or assembly such that the actuation lever of the trigger control mechanism or assembly is now engaged with the valve stem of the control valve mechanism or assembly of the fastener-driving tool although the control valve member of the control valve mechanism or assembly has not as yet been unseated from its valve seat in view of the fact that the trigger member of the trigger control mechanism or assembly is still disposed at its lowered position.

Accordingly, as disclosed within FIG. 10, when the workpiece contact element assembly has been moved upwardly as a result of being moved into engagement with the workpiece such that the upper end portion 158 of the workpiece contact element 118 is moved into engagement with the free distal end portion 160 of the actuation lever 130 of the trigger control mechanism or assembly 110, the actuation lever 130 of the trigger control mechanism or assembly 110 will now be disposed in engagement with the lower end portion of the valve stem 128 of the control valve mechanism or assembly 122 of the fastener-driving tool 112, although it is noted that the control valve member 124 of the control valve mechanism or assembly 122 has not as yet been unseated from its valve seat 126 in view of the fact that the trigger member 134 of the trigger control mechanism or assembly 110 is still disposed at its lowermost position. According, still further, as disclosed within FIG. 11, when the trigger member 134 of the trigger control mechanism or assembly 110 is depressed or moved upwardly, the control valve member 124 of the control valve mechanism or assembly 122 will now be opened or unseated from its valve seat 126 whereby a firing cycle of the fastener-driving tool 112 will in fact be initiated so as to discharge a fastener from the fastener-driving tool 112 in accordance with a sequential firing mode of operation. More particularly, as can be appreciated from FIG. 12, after the firing of the fastener-driving tool 112 and the discharge of a fastener from fastener-driving tool 112 into the workpiece, if it is desired to initiate another firing cycle within the fastener-driving tool 112 while the trigger member 134 of the trigger control mechanism or assembly 110 is maintained at its uppermost or depressed position, it is seen that the upper workpiece contact element 118 will be lowered from its position illustrated within FIG. 11 to that illustrated within FIG. 12 as a result of the lower workpiece contact element 116 having been disengaged from the workpiece.

Figure 12:
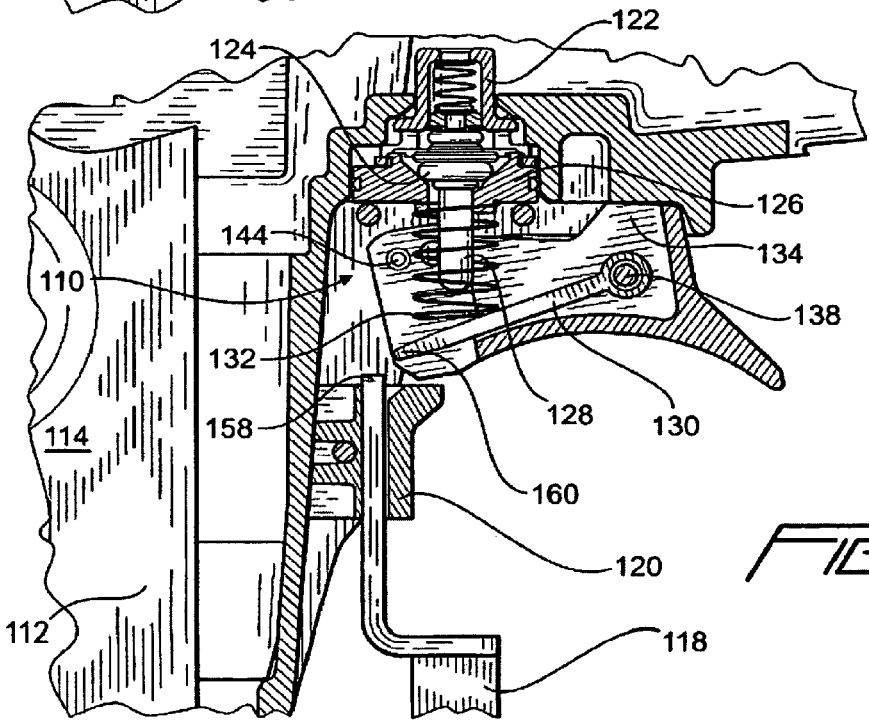
FIG. 12 is a cross-sectional view of the new and improved trigger control mechanism or assembly, similar to that disclosed within FIG. 11, wherein, however, the workpiece contact element assembly has been returned to its lowered position as a result of the lower workpiece contact element having been disengaged from the workpiece, however, the trigger member of the trigger control mechanism or assembly is illustrated as having been retained at its uppermost position whereby the actuation lever of the trigger control mechanism or assembly has now been disengaged from the valve stem of the control valve mechanism or assembly, under the influence of the coil spring of the control valve mechanism or assembly, whereby the control valve member of the control valve mechanism or assembly is again seated upon its valve seat so that the trigger member of the trigger control mechanism or assembly must be returned to its original, lowered, START position prior to the initiation of another firing cycle of the fastener-driving tool.
Figure 13:
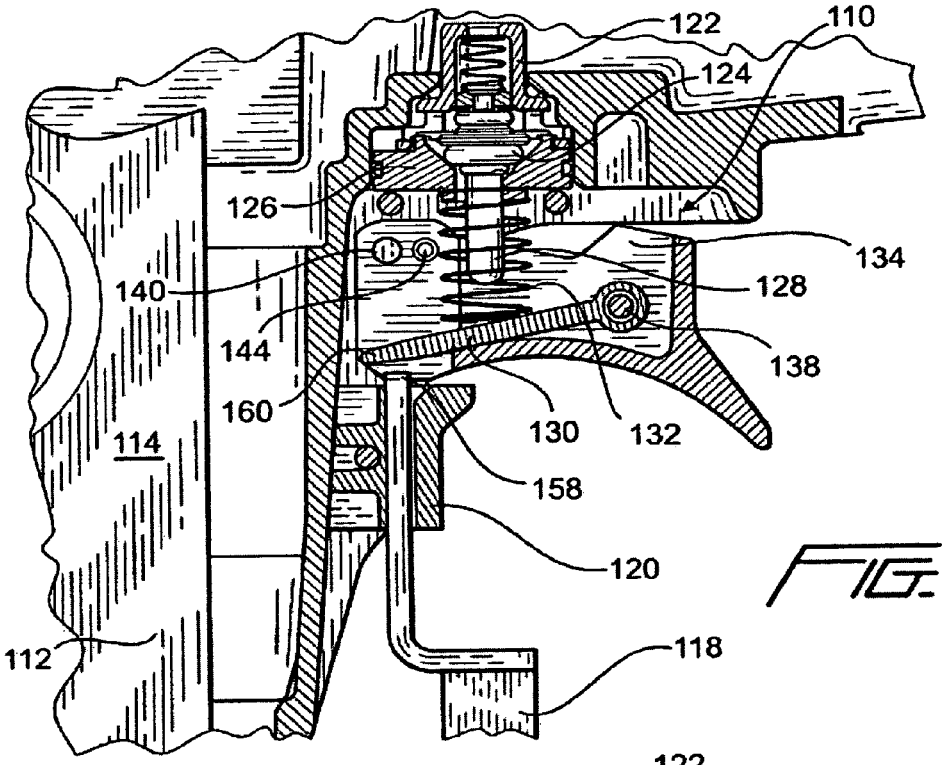
FIG. 13 is a cross-sectional view of the new and improved trigger control mechanism or assembly, similar to FIG. 9, wherein, however, the workpiece contact element assembly, the actuation lever of the trigger control mechanism or assembly, and the trigger member of the trigger control mechanism or assembly are all disposed at their initial, lowered, START positions prior to the initiation or actuation of the fastener-driving tool in its bump firing mode of operation wherein it is again noted, in particular, that the actuation lever of the trigger control mechanism or assembly is disengaged from the valve stem of the control valve mechanism or assembly of the fastener-driving tool.

Accordingly, the upper end portion 158 of the upper workpiece contact element 118 will be disengaged from the free distal end portion 160 of the actuation lever 130 whereby the actuation lever 130 will attain the position disclosed within FIG. 12, under the influence of the coiled biasing spring 132, such that the actuation lever 130 is disengaged from the lower end portion of the valve stem 128 whereupon the control valve member 124 of the control valve mechanism or assembly 122 will be permitted to again be seated upon its valve seat 126. Accordingly, still further, when the next firing cycle of the fastener-driving tool 112 is to be initiated, the lower workpiece contact element 116 will again be disposed in contact with the workpiece whereby the upper workpiece contact element 118 will accordingly be moved upwardly. It is to be noted, however, at this point in time, that due to the pivoted orientation of the trigger member 134 around the axis of the second pivot pin 144 as a result of the trigger member 134 having been maintained at its upper depressed position, the free distal end portion 160 of the actuation lever 130 will effectively have been removed from the vertical plane or path within which the upper end portion 158 of the upper workpiece contact element 118 will be movably disposed when a new firing cycle of the fastener-driving tool 112 is to be initiated.

Therefore, the upper end portion 158 of the upper workpiece contact element 118 will effectively bypass the free distal end portion 160 of the actuation lever 130 thereby failing to move the same into contact with the valve stem 128 of the control valve mechanism or assembly 122 in order to in fact initiate a new firing cycle for the fastener-driving tool 112. It can therefore be appreciated that in order to in fact initiate a new firing cycle in accordance with the sequential firing mode of operation of the fastener-driving tool 112, the trigger member 134 of the trigger control mechanism or assembly 110 must be returned to its original or initial START position, as illustrated within FIG. 9, prior to the re-engagement of the workpiece contact element assembly with the workpiece, so as to ensure the proper disposition of the free distal end portion 160 of the actuation lever 130 within the vertically upward path of movement of the upper end portion 158 of the upper workpiece contact element 118. In other words, this sequence of operations is required in connection with the sequential firing mode of operation of the fastener-driving tool 112 in that the same permits the downward pivoting of the trigger member 134, around the axis defined by means of the second pivot pin 144, so as to again effectively position the free distal end portion 160 of the actuation lever 130 within the vertical plane or upward movement path to be traveled by means of the upper end portion 158 of the upper workpiece contact element 118 when the same is moved upwardly as a result of the re-engagement of the workpiece contact element assembly with the workpiece.

With reference now being made to FIGS. 13-16, the bump firing mode of operation of the fastener-driving tool 112 will now be described. It will be apparent, as a result of reference being made to FIG. 13, that the various components of the trigger control mechanism or assembly 110, in connection with the bump firing mode of operation of the fastener-driving tool 112, are disposed at similar START positions as were the components of the trigger control mechanism or assembly 110 in connection with the sequential firing mode of operation of the fastener-driving tool 112, as has been previously illustrated and described in connection with FIG. 9, with the exception that the trigger member 134 of the trigger control mechanism or assembly 110 has now been re-positioned within the tool housing 114 of the fastener-driving tool 112 as a result of the second pivot pin 144 having been removed from the second through-bore 140 of the trigger member 134, as well as having been removed from the through-bore 150 defined within the tool housing 114, as permitted by removal of the O-ring fastener member 148 from the recessed portion 146 of the second pivot pin 144, the trigger member 134 has been shifted toward the left as viewed in the drawings so as to effectively align the third through-bore 142 of the trigger member 134 with the through-bore 150 of the tool housing 114, the second pivot pin 144 has been re-inserted into and through the third through-bore 142 of the trigger member 134 and the through-bore 150 of the tool housing 114, and the second pivot pin 144 has been re-secured within the trigger member 134 and the tool housing 114 by re-inserting the O-ring fastener member 148 within the recessed portion 146 of the second pivot pin 144. It can therefore be appreciated still further that with the trigger member 134 now disposed at this new position, the free distal end portion 160 of the actuation lever 130 is disposed substantially to the left of, or substantially overlaps, the upper end portion 158 of the upper workpiece contact element 118.

Figure 11:
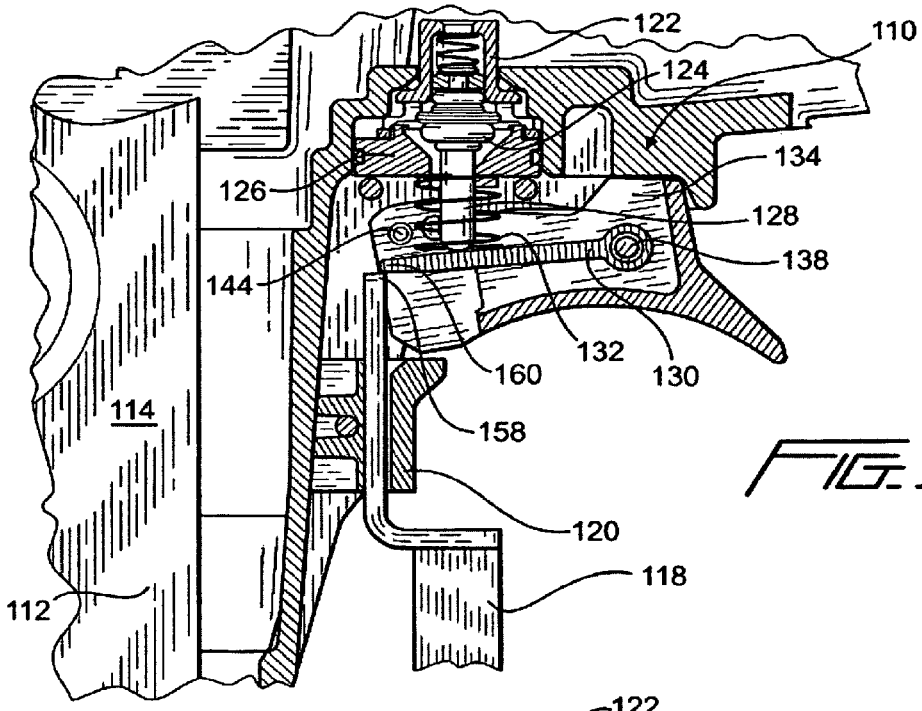
FIG. 11 is a cross-sectional view of the new and improved trigger control mechanism or assembly, similar to that disclosed within FIG. 10, wherein, however, the trigger member of the trigger control mechanism or assembly has now also been moved upwardly so as to unseat the control valve member of the control valve mechanism or assembly from its valve seat and therefore initiate a firing of the fastener-driving tool in order to discharge a fastener from the fastener-driving tool in accordance with a sequential firing mode of operation.
Figure 14:
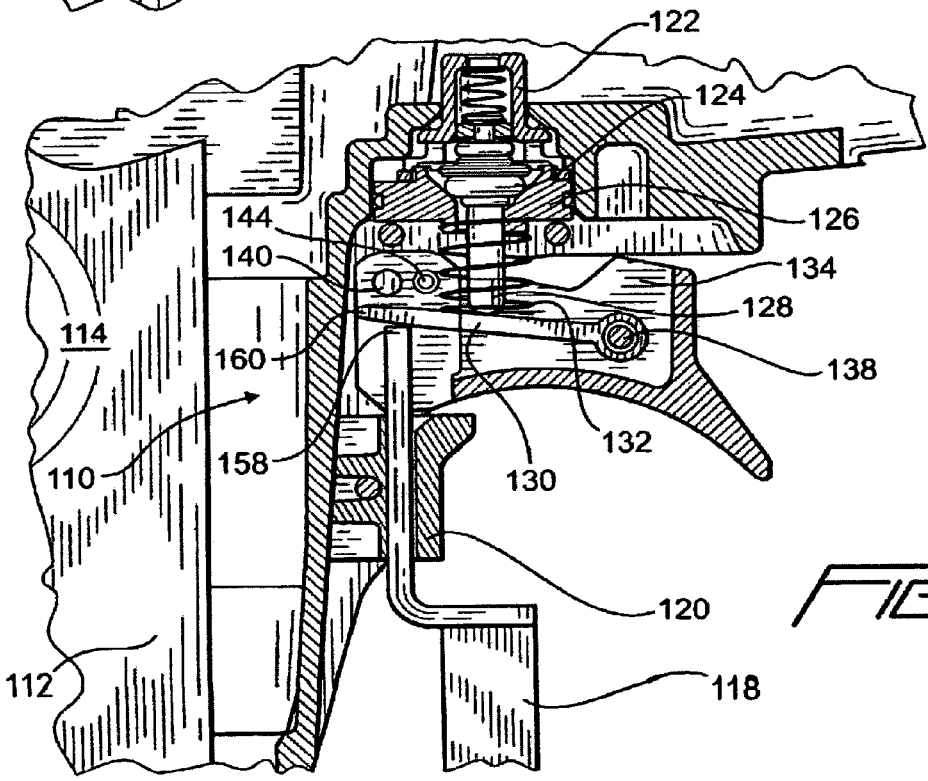
FIG. 14 is a cross-sectional view of the new and improved trigger control mechanism or assembly, as disclosed within FIG. 13 in preparation for the initiation of a bump firing mode of operation, but also similar to that disclosed within FIG. 10 in that the workpiece contact element assembly has been moved upwardly into engagement with the actuation lever of the trigger control mechanism or assembly such that the actuation lever of the trigger control mechanism or assembly is now engaged with the valve stem of the control valve mechanism or assembly of the fastener-driving tool although the control valve member of the control valve mechanism or assembly has not as yet been unseated from its valve seat in view of the fact that the trigger member of the trigger control mechanism or assembly is still disposed at its lowered position.
Figure 15:
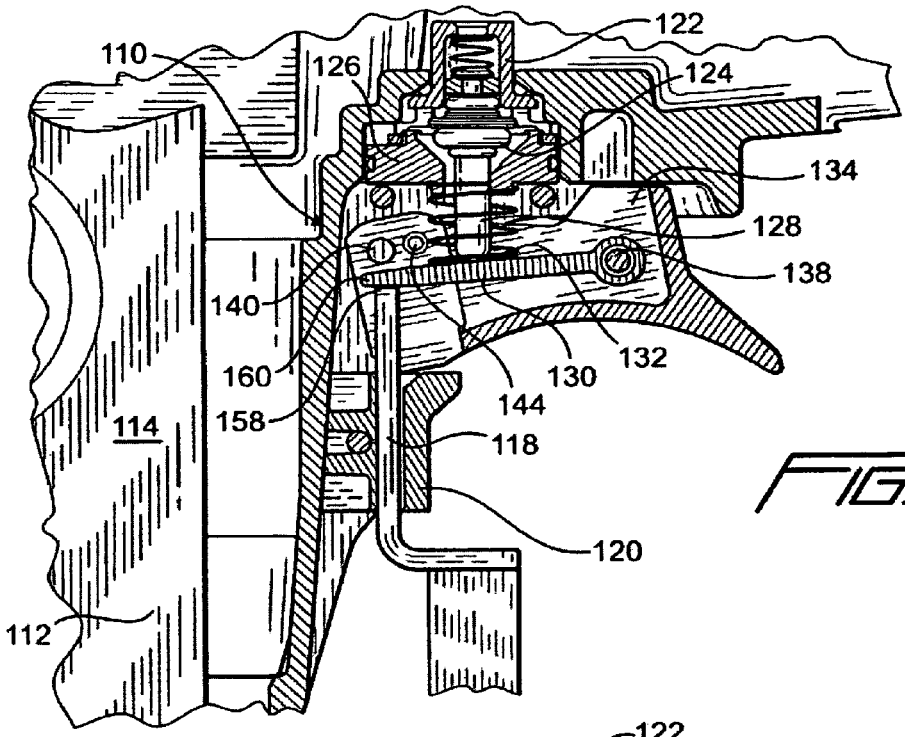
FIG. 15 is a cross-sectional view of the new and improved trigger control mechanism or assembly, as disclosed within FIG. 14 but similar to that disclosed within FIG. 11 in that the trigger member of the trigger control mechanism or assembly has now also been moved upwardly so as to unseat the control valve member of the control valve mechanism or assembly from its valve seat and therefore initiate a firing of the fastener-driving tool in order to discharge a fastener from the fastener-driving tool in accordance with a bump firing mode of operation.

Therefore, it is seen, and readily appreciated still further, that the disposition of the various components comprising the trigger control mechanism or assembly 110 will be disposed in substantially the same positions, and will interact together in substantially the same manner with respect to each other, during the bump firing mode of operation, as illustrated within FIGS. 14 and 15, as has been previously illustrated and described in connection with the various components during the sequential firing mode of operation, as has been illustrated within FIGS. 10 and 11, that is, when the upper workpiece contact element 118 has been moved upwardly into engagement with the actuation lever 130 of the trigger control mechanism or assembly 110, as a result of the lower workpiece contact element 116 being engaged with a workpiece, such that the actuation lever 130 of the trigger control mechanism or assembly 110 is now engaged with the valve stem 128 of the control valve mechanism or assembly 122 of the fastener-driving tool 112 although the control valve member 124 of the control valve mechanism or assembly 122 has not as yet been unseated from its valve seat 126 in view of the fact that the trigger member 134 of the trigger control mechanism or assembly 110 is still disposed at its lowermost position, and subsequently, when the trigger member 134 of the trigger control mechanism or assembly 110 has been moved upwardly so as to unseat the control valve member 124 of the control valve mechanism or assembly 122 from its valve seat 126 and therefore initiate the firing of the fastener-driving tool 112 in order to discharge a fastener from the fastener-driving tool 112 in accordance with a bump firing mode of operation. The primary difference between the operations of the fastener-driving tool 112 during the sequential and bump firing modes of operation occurs when a subsequent firing cycle is to be initiated as can be readily appreciated from a comparison of FIGS. 12 and 16.

Figure 16:
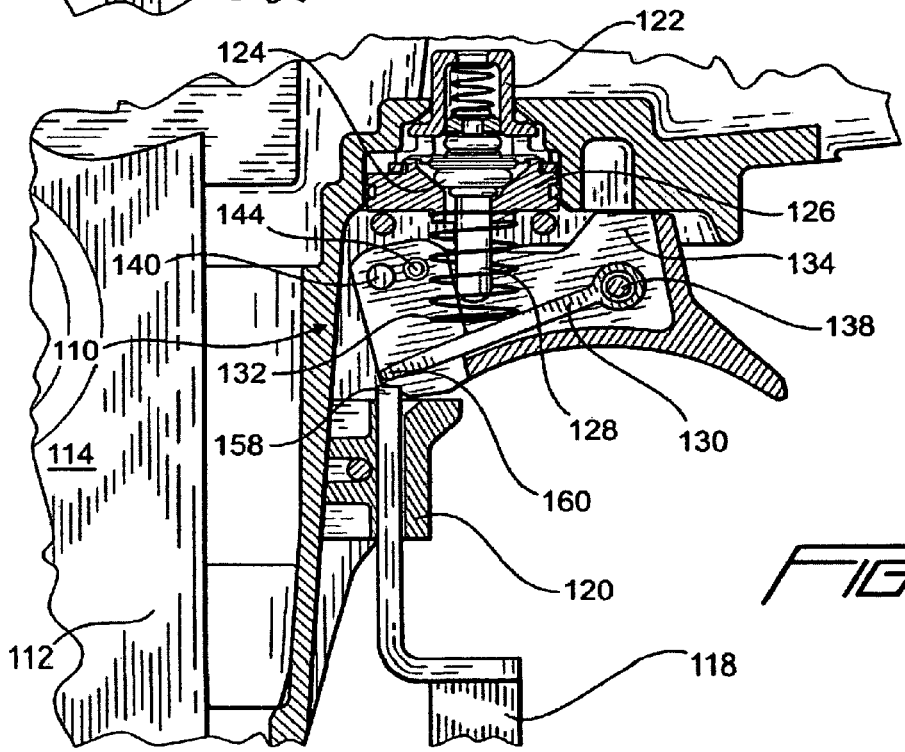
FIG. 16 is a cross-sectional view of the new and improved trigger control mechanism or assembly, as disclosed within FIG. 15 but similar to that disclosed within FIG. 12 in that the workpiece contact element assembly has been returned to its lowered position as a result of the lower workpiece contact element having been disengaged from the workpiece, however, the trigger member of the trigger control mechanism or assembly is illustrated as having been retained at its uppermost position whereby the actuation lever of the trigger control mechanism or assembly has now been disengaged from the valve stem of the control valve mechanism or assembly, under the influence of the coil spring of the control valve mechanism or assembly, whereby the control valve member of the control valve mechanism or assembly is again seated upon its valve seat, and yet, a new firing cycle of the fastener-driving tool may be initiated without releasing the trigger member of the trigger control mechanism or assembly.

More particularly, after a firing cycle of the fastener-driving tool 112 has been completed during the bump firing mode of operation, and a subsequent firing cycle is to be initiated while the trigger member 134 of the trigger control mechanism or assembly 110 is maintained depressed at its uppermost position as illustrated within FIG. 16, the lower workpiece contact element 116 is disengaged from the workpiece whereby the upper workpiece contact element 118 is returned to its lowermost position, as illustrated within FIG. 16, whereby the actuation lever 130 of the trigger control mechanism or assembly 110 has now been disengaged from the valve stem 128 of the control valve mechanism or assembly 122, under the influence of the coil spring 132 of the control valve mechanism or assembly 122, whereby the control valve member 124 of the control valve mechanism or assembly 122 is again seated upon its valve seat 126. However, it is to be noted and appreciated that despite the angled or pivoted disposition of the trigger member 134 around the axis of the second pivot pin 144, the free distal end portion 160 of the actuation lever 130 is still disposed within the vertical plane or path of movement of the upper end portion 158 of the upper workpiece contact element 118.

Accordingly, when a new firing cycle of the fastener-driving tool 112 is to be initiated, while the trigger member 134 of the trigger control assembly or mechanism 110 is maintained at its uppermost, depressed position as illustrated within FIG. 16, the upper end portion 158 of the upper workpiece contact element 118 will, unlike the relative disposition characteristic of the tool components during a sequential firing mode of operation of the fastener-driving tool 112 as illustrated within FIG. 12, not in fact bypass the free distal end portion 160 of the actuation lever 130, and will in fact engage the free distal end portion 160 of the actuation lever 130. In this manner, the actuation lever 130 will be moved upwardly into contact with the lower end portion of the valve stem 128 of the control valve mechanism or assembly 122, the valve member 124 of the control valve mechanism or assembly 122 will be unseated from its valve seat 126, and a new firing cycle of the fastener-driving tool 112 will be initiated. This process may of course be repeated as often as desired so as to achieve multiple firing cycles of the fastener-driving tool 112 in accordance with the bump firing mode of operation of the fastener-driving tool 112.

Thus, it may be seen that in accordance with the principles and teachings of the present invention, there has been disclosed a new and improved trigger control assembly or mechanism which can be readily, easily, and quickly repositioned upon a fastener-driving tool in order to readily, easily, and quickly switch the mode of operation of the fastener-driving tool between a sequential mode of operation and a bump firing mode of operation. In addition, as has been noted hereinbefore, while the aforenoted switching of the mode of operation of the fastener-driving tool between the sequential and bump firing modes of operation has been accomplished by, for example, providing the trigger member with a pair of the through-bores for alternatively accommodating the second pivot pin, while the tool housing is provided with a single through-bore for accommodating the second pivot pin, the structure of the trigger member and the tool housing may effectively be reversed wherein the trigger member is provided with a single through-bore for accommodating the second pivot pin, while the tool housing is provided with a pair of through-bores for alternatively accommodating the second pivot pin.

Obviously, many variations and modifications of the present invention are possible in light of the above teachings. It is therefore to be understood that within the scope of the appended claims, the present invention may be practiced otherwise than as specifically described herein.

What is claimed is:

1. A method of alternatively operating a fastener-driving tool, having a trigger control mechanism mounted thereon, in accordance with both sequential and bump-firing modes of operation, comprising the steps of:

mounting a workpiece contacting element upon a housing of said fastener-driving tool for movement along a predetermined path;

mounting a control valve upon said housing of said fastener-driving tool;

movably mounting a trigger member upon said housing of said fastener-driving tool;

movably mounting a first end portion of an actuation lever upon said trigger member, for actuating said control valve of said fastener-driving tool, upon said trigger member such that a second end portion of said actuation member is adapted to be operatively engaged with said workpiece contacting element when said workpiece contacting element is moved along said predetermined path toward said actuation lever in response to the depression of said workpiece contacting element against a workpiece;

providing a single aperture within said fastener-driving tool housing;

providing a pair of separate, transversely spaced apertures within said trigger member;

removably mounting a pivot pin upon said fastener-driving tool for disposition within said single aperture of said fastener-driving tool housing and for selective disposition in an alternative manner with said pair of separate, transversely spaced apertures of said trigger member such that when said pivot pin is disposed within a first one of said paid of separate, transversely spaced apertures defined upon said trigger member and disposed within said single aperture defined within said fastenerdriving tool housing, said trigger member, and said actuation lever mounted upon said trigger member, will be mounted at a first one of two different positions upon said fastener-driving tool housing such that said second end portion of said actuation lever will be disposed at a first position relative to said predetermined path of movement of said workpiece contacting element of said fastener-driving tool so as to permit said actuation lever to actuate said control valve of said fastener-driving tool only when said trigger member is actuated to its operative position subsequent to the depression of said workpiece contacting element against a workpiece whereby a sequential firing mode of operation of said fastener-driving tool can be achieved;

removing said pivot pin from said single aperture defined within said fastener-driving tool housing and from said first one of said pair of separate, transversely spaced apertures defined within said trigger member; and inserting said pivot pin into said second one of said pair of separate, transversely spaced apertures defined within said trigger member, such that said pivot pin is also re-inserted into said single aperture defined within said tool housing, whereby said trigger member, and said actuation lever mounted upon said trigger member, are now mounted at a second one of said two different positions upon said fastener-driving tool such that said actuation lever will be disposed at a second position relative to said predetermined path of movement of said workpiece contacting element of said fastener-driving tool so as to permit said actuation lever to always actuate said control valve of said fastener-driving tool regardless of when said trigger member is actuated to its operative position with respect to the depression of said workpiece contacting element against the workpiece whereby a bump-firing mode of operation of said fastener-driving tool can be achieved.

2. The method of operating the fastener-driving tool as set forth in claim 1, further comprising the steps of:

providing first indicia upon said trigger member for respectively graphically illustrating the sequential and bump-firing modes of operation for said fastener-driving tool; and providing second indicia upon said fastener-driving tool housing for correctly indicating said first indicia disposed upon said trigger member so as to inform an operator which one of said sequential and bump-firing modes of operation said fastenerdriving tool is pre-arranged to achieve.

3. The method of operating the fastener-driving tool as set forth in claim 2, further comprising the steps of:

providing said first indicia upon said trigger member as a pair of illustrations wherein a first one of said pair of illustrations comprises a single fastener for indicating said sequential mode of operation, and a second one of said pair of illustrations comprises a plurality of fasteners for indicating said bump-firing mode of operation; and providing said second indicia upon said fastener-driving tool housing as an arrow for pointing toward one of said pair of illustrations comprising said first indicia.

4. The method of operating the fastener-driving tool as set forth in claim 3, further comprising the step of:

transversely spacing said pair of illustrations from each other such that when said trigger member is mounted upon said fastener-driving tool housing at said first one of said two different positions, said arrow upon said fastener-driving tool housing will point to said first illustration indicating said sequential mode of operation, whereas when said trigger member is mounted upon said fastener-driving tool housing at said second one of said two different positions, said arrow upon said fastener-driving tool housing will point to said second illustration indicating said bump-firing mode of operation.

5. A trigger control mechanism for use in connection with a fastener-driving tool so as to enable the fastener-driving tool to alternatively operate in accordance with sequential and bump-firing modes of operation, comprising:

a tool housing having a single aperture defined therein;

a trigger member;

an actuation lever for actuating a control valve of a fastener-driving tool, said actuation lever having a first end portion which is pivotally mounted upon said trigger member, and a second end portion which is adapted to be operatively engaged with a workpiece contacting element which is mounted upon the fastener-driving tool for movement along a predetermined path toward and away from said actuation lever in response to the respective depression of the workpiece contacting element against a workpiece, and and which is adapted to be operatively disengaged from the workpiece contacting element when the workpiece contacting element is disengaged from the workpiece;

a pair of separate, transversely spaced apertures defined within said trigger member of said fastener-driving tool; and a pivot pin removably mounted upon the fastener-driving tool with respect to said single aperture defined within said tool housing and selectively disposable in an alternative manner within said pair of separate, transversely spaced apertures of said trigger member for pivotally mounting said trigger member upon the fastener-driving tool such that when said pivot pin is disposed within said single aperture defined within said tool housing and within a first one of said pair of separate, transversely spaced apertures, said trigger member will be mounted upon the fastener-driving tool at a first one of said two different positions at which said second end portion of said actuation lever will be disposed at a first position relative to the predetermined path of movement of the workpiece contacting element of the fastener-driving tool so as to permit said actuation lever to actuate the control valve of the fastener-driving tool only when said trigger member is actuated to its operative position subsequent to the depression of the workpiece contacting element against a workpiece whereby a sequential firing mode of operation of the fastener-driving tool can be achieved, whereas when said pivot pin is removed from said single aperture defined within said tool housing and said first one of said pair of separate, transversely spaced apertures, and inserted into said second one of said pair of separate, transversely spaced apertures so as to also be re-inserted into said single aperture defined within said tool housing, said trigger member will be mounted upon the fastener-driving tool at said second one of said two different positions relative to the predetermined path of movement of the workpiece contacting element of the fastener-driving tool so as to permit said actuation lever to always actuate the control valve of the fastener-driving tool regardless of when said trigger member is actuated to its operative position with respect to the depression of the workpiece contacting element against the workpiece whereby a bump-firing mode of operation of the fastener-driving tool can be achieved.

6. The trigger control mechanism as set forth in claim 5, further comprising:

indicia disposed upon said trigger member for respectively graphically illustrating the sequential and bump firing modes of operation for the fastener-driving tool.

7. The trigger control mechanism as set forth in claim 6, wherein:

said indicia disposed upon said trigger member comprises a pair of illustrations wherein a first one of said pair of illustrations comprises a single fastener for indicating said sequential mode of operation, and a second one of said pair of illustrations comprises a plurality of fasteners for indicating said bump-firing mode of operation.

8. The fastener-driving tool as set forth in claim 7, wherein:

said pair of illustrations are transversely spaced from each other such that when said trigger member is mounted upon said fastener-driving tool housing at said first one of said two different positions, both of said pair of illustrations will be visible indicating said sequential firing mode of operation, whereas when said trigger member is mounted upon said fastener-driving tool housing at said second one of said two different positions, only said second illustration indicating said bump-firing mode of operation will be visible.

9. A fastener-driving tool having a trigger control mechanism for enabling the fastener-driving tool to alternatively operate in accordance with sequential and bump-firing modes of operation, comprising:

a fastener-driving tool housing;

a single aperture defined within said fastener-driving tool housing;

a workpiece contacting element mounted upon said fastener-driving tool housing for movement along a predetermined path;

a control valve mounted upon said fastener-driving tool housing of said fastener driving tool;

a trigger member;

an actuation lever for actuating said control valve of said fastener-driving tool, said actuation lever having a first end portion which is pivotally mounted upon said trigger member, and a second end portion which is adapted to be operatively engaged with said workpiece contacting element when said workpiece contacting element is moved along said predetermined path toward said actuation lever in response to the depression of said workpiece contacting element against a workpiece, and which is adapted to be disengaged from said workpiece contacting element when said workpiece contacting element is disengaged from the workpiece;

a pair of separate, transversely spaced apertures defined within said trigger member; and a pivot pin removably mounted upon said fastener-driving tool with respect to said single aperture defined within said fastener-driving tool housing and selectively disposable in an alternative manner within said pair of separate, transversely spaced apertures of said trigger member for pivotally mounting said trigger member upon said fastener-driving tool such that when said pivot pin is disposed within said single aperture of said fastener-driving tool housing and within a first one of said pair of separate, transversely spaced apertures, said trigger member will be mounted upon said fastener-driving tool at a first one of said two different positions at which said second end portion of said actuation lever will be disposed at a first position relative to said predetermined path of movement of said workpiece contacting element of said fastener-driving tool so as to permit said actuation lever to actuate said control valve of said fastener-driving tool only when said trigger member is actuated to its operative position subsequent to the depression of said workpiece contacting element against a workpiece whereby a sequential firing mode of operation of said fastener-driving tool can be achieved, whereas when said pivot pin is removed from said single aperture defined within said fastener-driving tool housing and from first one of said pair of separate, transversely spaced apertures, and inserted into said second one of said pair of separate, transversely spaced apertures so as to also be re-inserted into said single aperture defined within said fastener-driving tool housing, said trigger member will be mounted upon said fastener-driving tool at said second one of said two different positions relative to said predetermined path of movement of said workpiece contacting element of said fastener-driving tool so as to permit said actuation lever to always actuate said control valve of said fastener-driving tool regardless of when said trigger member is actuated to its operative position with respect to the depression of said workpiece contacting element against the workpiece whereby a bump-firing mode of operation of the fastener-driving tool can be achieved.

10. The fastener-driving tool as set forth in claim 9, further comprising:

first indicia is disposed upon said trigger member for respectively graphically illustrating the sequential and bump-firing modes of operation for said fastener-driving tool; and second indicia is disposed upon said fastener-driving tool housing for correctly indicating said first indicia disposed upon said trigger member so as to inform an operator which one of said sequential and bump-firing modes of operation said fastener-driving tool is prearranged to achieve.

11. The fastener-driving tool as set forth in claim 10, wherein:

said first indicia disposed upon said trigger member comprises a pair of illustrations wherein a first one of said pair of illustrations comprises a single fastener for indicating said sequential mode of operation, and a second one of said pair of illustrations comprises a plurality of fasteners for indicating said bump-firing mode of operation; and said second indicia disposed upon said fastener-driving tool housing comprises an arrow for pointing toward one of said pair of illustrations.

12. The fastener-driving tool as set forth in claim 11, wherein:

said pair of illustrations are transversely spaced from each other such that when said trigger member is mounted upon said fastener-driving tool housing at said first one of said two different positions, said arrow upon said fastener-driving tool housing will point to said first illustration indicating said sequential mode of operation, whereas when said trigger member is mounted upon said fastener-driving tool housing at said second one of said two different positions, said arrow upon said fastener-driving tool housing will point to said second illustration indicating said bump-firing mode of operation.

* * * * *